United States Patent [19]

Gimben

[11] Patent Number: 4,645,151

[45] Date of Patent: Feb. 24, 1987

[54] CABLE AND CONNECTION APPARATUS FOR ELECTROSTATIC POWDER GUNS

[75] Inventor: Dale N. Gimben, Grafton, Ohio

[73] Assignee: Nordson Corporation, Amherst, Ohio

[21] Appl. No.: 735,961

[22] Filed: May 20, 1985

[51] Int. Cl.[4] ..... H01R 11/00; H01R 13/58; B05B 3/00

[52] U.S. Cl. ..... 248/52; 239/690; 335/205; 339/58; 339/103 R

[58] Field of Search ..... 239/690, 691, 695, 525, 239/526, 527; 200/61.85, 57; 335/205, 151; 339/58, 103 R, 100 M, 103 M; 24/457, 458, 514; 248/51, 52, 65; 403/387, 389, 390

[56] References Cited

U.S. PATENT DOCUMENTS

| | | | |
|---|---|---|---|
| 1,977,224 | 10/1934 | Albertson | 339/58 |
| 2,323,829 | 7/1943 | McArthur | 403/389 X |
| 2,670,238 | 2/1954 | Lansing et al. | 239/527 X |
| 2,897,255 | 5/1956 | Gesellschap | 248/65 X |
| 3,250,875 | 5/1966 | Wintress | 335/151 |
| 3,367,578 | 2/1968 | Juvinall et al. . | |
| 3,461,874 | 8/1969 | Martinez | 335/205 X |
| 3,517,262 | 6/1970 | Juvinall et al. . | |
| 3,599,038 | 7/1969 | Skidmore . | |
| 3,608,823 | 9/1971 | Buscher . | |
| 3,731,145 | 5/1973 | Senay . | |
| 3,737,099 | 6/1973 | Shaffer . | |
| 3,746,254 | 7/1973 | Duncan et al. . | |
| 3,815,820 | 6/1974 | Probst . | |
| 3,870,233 | 3/1975 | Wilhelm et al. | 239/15 |
| 3,913,956 | 10/1975 | Eidelberg et al. | 339/103 R X |
| 3,980,980 | 9/1976 | Zioni et al. | 335/151 X |
| 4,018,500 | 4/1977 | Hamacher | 339/103 R |
| 4,294,411 | 10/1981 | Hastings et al. | 239/707 |
| 4,323,947 | 4/1982 | Huber . | |
| 4,331,298 | 5/1982 | Bentley et al. | 239/690 |
| 4,335,851 | 6/1982 | Hastings | 239/3 |
| 4,355,764 | 10/1982 | Rood et al. | 239/708 |
| 4,447,100 | 5/1984 | Dyce et al. | 339/103 M X |

FOREIGN PATENT DOCUMENTS

| | | | |
|---|---|---|---|
| 3038596 | 4/1982 | Fed. Rep. of Germany | 239/690 |

*Primary Examiner*—Joseph F. Peters, Jr.
*Assistant Examiner*—Kevin P. Weldon
*Attorney, Agent, or Firm*—Wood, Herron & Evans

[57] ABSTRACT

An improved control cable terminal for an electrostatic spraying gun includes a magnetically operated reed switch and an insulating body encapsulating both the switch and control wires at the gun end of the control cable. The body defines a switch plug insertable into the gun in operative relationship with a magnetic trigger element. Control cable plugs and receptacles are eliminated as are stresses on the control wires and reed switch. A bracket secures the insulating body to a tool removable coupling holding an electrostatic cable in the gun. The bracket prevents removal of the control cable switch plug, except by tool removal of the electrostatic cable coupling nut.

7 Claims, 4 Drawing Figures

CABLE AND CONNECTION APPARATUS FOR ELECTROSTATIC POWDER GUNS

This invention relates to electrostatic spray coating systems and more particularly to an improved control cable and apparatus for connecting a control cable to an electrostatic spray gun.

Electrostatic spray guns are used in varied industrial applications for spraying materials, comprising electrically charged particles, onto surfaces maintained at an electrostatic potential different than that of the particles. Typically, such guns have high voltage particle charging electrodes, provided with current through an electrostatic cable connected between an electrostatic potential source and the gun. Such electrostatic cables are secured to the gun by tool removable means, such as retaining nuts or couplings. Maintaining the cable's positive connection to the gun via a tool-only removable device is an important safety provision, insuring that a hot cable will not be easily or inadvertently removed so as to expose a terminal.

Such electrostatic guns have also included a trigger switch, such as a manually, pneumatically or a magnetically operable reed switch. Such switches typically are connected, through low voltage control wires, to a relay switch at the electrostatic source. The relay serves to selectively pass or interrupt high voltage current flow through the electrostatic cable to the gun. In the past, the reed switch has been wired to a receptacle located in the gun handle.

The control cable, extending from the relay, included low voltage control wires terminating in a two-prong plug. This plug was inserted into the gun-mounted receptacle to connect the reed switch to the relay.

Usually, the control wires extended along the electrostatic cable, with their plug end separating therefrom for connection to the receptacle. While the electrostatic cable could only be removed from the gun by means of a tool, the control wires could be manually or inadvertently unplugged therefrom, exposing the plug prongs, and the receptacle leading to the reed switch. Alternatively, the control wire plug connection could work itself apart due to relative movement between the control wires and plug and the receptacle.

Also, in past guns, the receptacle included a receptacle body of insulating material carrying receptacle terminals wired to the reed switch by connecting wires. The receptacle was frictionally held in the gun. Any "working" of the receptacle, by plugging or unplugging the control wires, or by movement of the gun with respect to the control wires, tended to loosen the receptacle and to stress the connecting wires between the receptacle and the reed switch. Such stress was highly detrimental to the integrity of the relatively delicate connection of the connecting wires to the reed switch, and in some instances could cause a disconnection, rendering the gun useless.

It has become highly desirable to prevent easy or inadvertent disconnection of the control wires at the gun handle, and to eliminate or reduce stresses on the reed switch and connecting wires of an electrostatic spray gun.

Accordingly, one objective of this invention has been to provide positive, tool operable, connecting means for the control cable of an electrostatic spray gun.

A further objective of the invention has been to provide an improved control cable and switch for an electrostatic spray gun.

To these ends, a preferred embodiment of the invention comprises an integral switch plug constituting an integral part of the control cable system and not disconnectable therefrom. A magnetically operated reed switch is permanently wired at the control cable ends within the plug and is commonly encapsulated with terminal ends of the control cable to form an integral, insertable switch plug for introduction into a spray gun handle proximate a trigger-connected and movable magnet. The switch plug is held in the gun by tool removable means comprising a coupling bracket integrally secured to the coupling nut for the electrostatic cable. The control switch plug can only be removed from the gun handle when the electrostatic coupling nut is removed by means of an appropriate tool.

Accordingly, not only is the control switch now integral with the control cable, but there is no plug or receptacle, nor are there any plug or receptacle parts required. Physical stresses exerted on the low voltage control cable do not tend to disrupt their connection to the switch, in view of the fact that the entire terminal end of the control cable assembly, including the switch, is integral. Any stresses exerted on the cable are transferred to the insulating body of the switch plug, and not to any connection between the reed switch and its connecting wires.

Moreover, the switch plug cannot be removed from the spray gun, except by means of the appropriate tool for uncoupling the electrostatic cable. Apart from the coupling bracket, no other extra components are required to render the control wires removable only by tool.

These and other objectives and advantages will become readily apparent from the following detailed description of a preferred embodiment of the invention and from the drawings in which.

Figure 1:
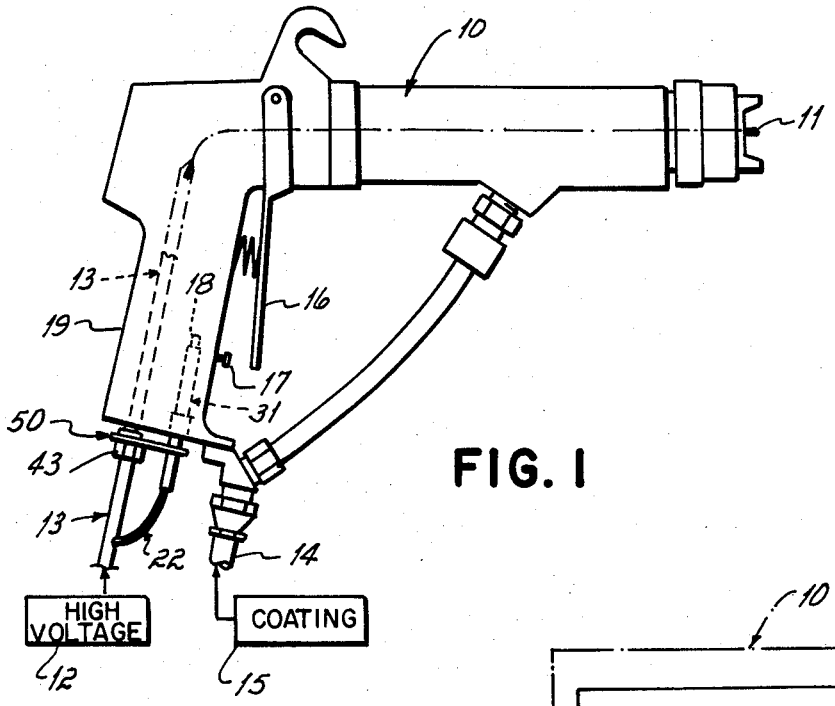
FIG. 1 is a diagrammatic view of an electrostatic spray gun and of an electrostatic cable and control cable system according to the invention.

Turning now to the drawings, and particularly FIG. 1 thereof, there is shown a diagrammatic illustration of an electrostatic spray coating system of the type to which this invention relates. As shown in FIG. 1, the coating system includes a gun 10, considered to be a spray device for emitting particles toward an object to be coated. The coated particles may be in the form of powder transported to the gun 10 in a fluid stream, such as air, or in the form of liquid such as paint, varnish, lacquer, or the like, which has been atomized by the gun 10 utilizing conventional air atomization, hydraulic atomization ("airless") and/or rotary atomization principles. Associated with the spray gun 10 is an electrode 11 which causes the particles emitted by the gun to carry an electrostatic charge. An article or surface to be coated is maintained at an electrostatic potential different than that of the charged coating particles. When the charged particles are propelled by the gun 10 toward the article, the particles will be deposited on the article with improved efficiency, coverage, and the like. Depending upon the particular construction of the spray gun 10, or other spraying device and its associated electrodes, the electrical charge transfer mechanism may involve contact charging, corona charging, inductive charging, and/or ionization, etc., in accordance with charging principles which are well known in the electrostatic coating field. Also associated with the spray gun 10 is a high voltage electrostatic supply 12 for providing electrostatic potentials of approximately 50 kilovolts or more to the charging electrode through an electrostatic cable 13. Typically, the high voltage electrostatic supply 12 is remotely located with respect to the spray gun 10, with the insulated electrostatic cable being connected between the gun 10 and the remote power supply 12.

Alternately, a high voltage electrostatic supply (not shown) may be mounted to or incorporated in the spraying device 10, in which case electrical energy is transmitted to the device 10 from a remote low voltage source via an electric cable (not shown) which need only be insulated for safe operation at low voltage.

Illustrative electrostatic liquid spray coating systems of the overall type mentioned above are disclosed in U.S. Pat. Nos. 3,367,578; 4,335,851; 3,870,233; and 4,355,764. A powder spray gun supplied from a remote high voltage supply of known type is shown in U.S. Pat. No. 3,746,254. Illustrative of those types of spraying systems utilizing low voltage supply to a high voltage electrostatic supply in the spraying device are U.S. Pat. Nos. 3,731,145; 3,608,823; 3,599,038; 4,323,947; and 4,331,298. It should be appreciated that the invention as described herein may be utilized in any of these varied types of systems and as further noted.

Continuing further with reference to FIG. 1, the gun 10 is connected through an appropriate conduit 14 to a coating supply 15. The gun 10 includes a trigger 16 positioned to engage a spring loaded reciprocal magnet member 17 for movement of the magnet toward and away from a reed switch 18. The reed switch 18 is connected, through appropriate circuitry as will be described, to a control relay 20 for the purpose of controlling the delivery of high voltage electrostatic energy to the electrode 11 in the front end of the gun through the electrostatic cable 13. Accordingly, when trigger 16 is squeezed by a user, magnet 17 is moved toward the reed switch 18, whereupon the reed switch closes to energize the electrostatic cable 13 as will be described.

Figure 2:
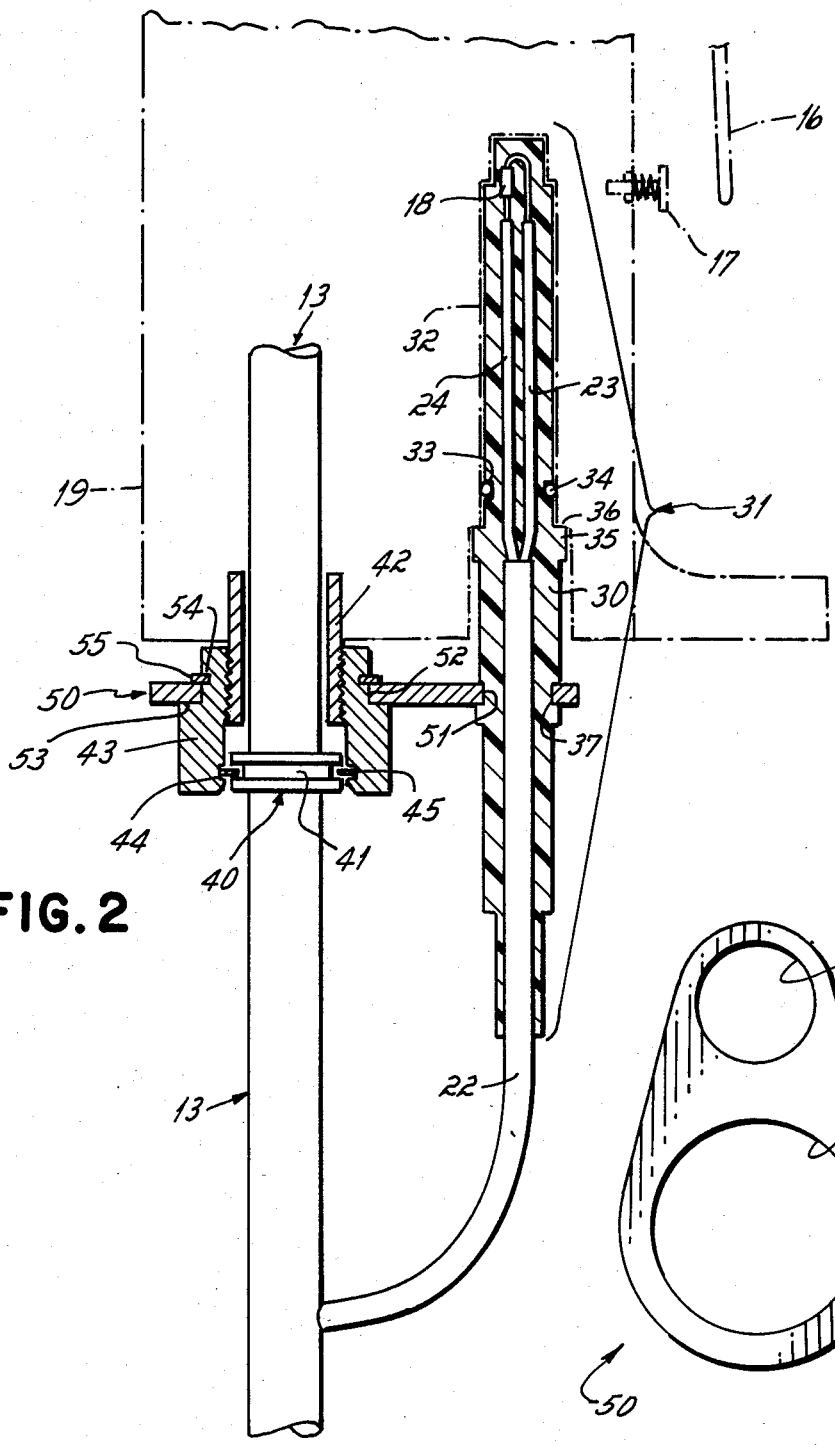
FIG. 2 is an enlarged diagrammatic view of the handle of the electrostatic spray gun of FIG. 1, showing the cable system in more detail.

Attention is directed to FIG. 2 of the drawings which diagrammatically shows an enlarged handle 19 of the gun 10 of FIG. 1 with an electrostatic cable and control cable system including means for securing the respective cables to the gun.

Figure 3:
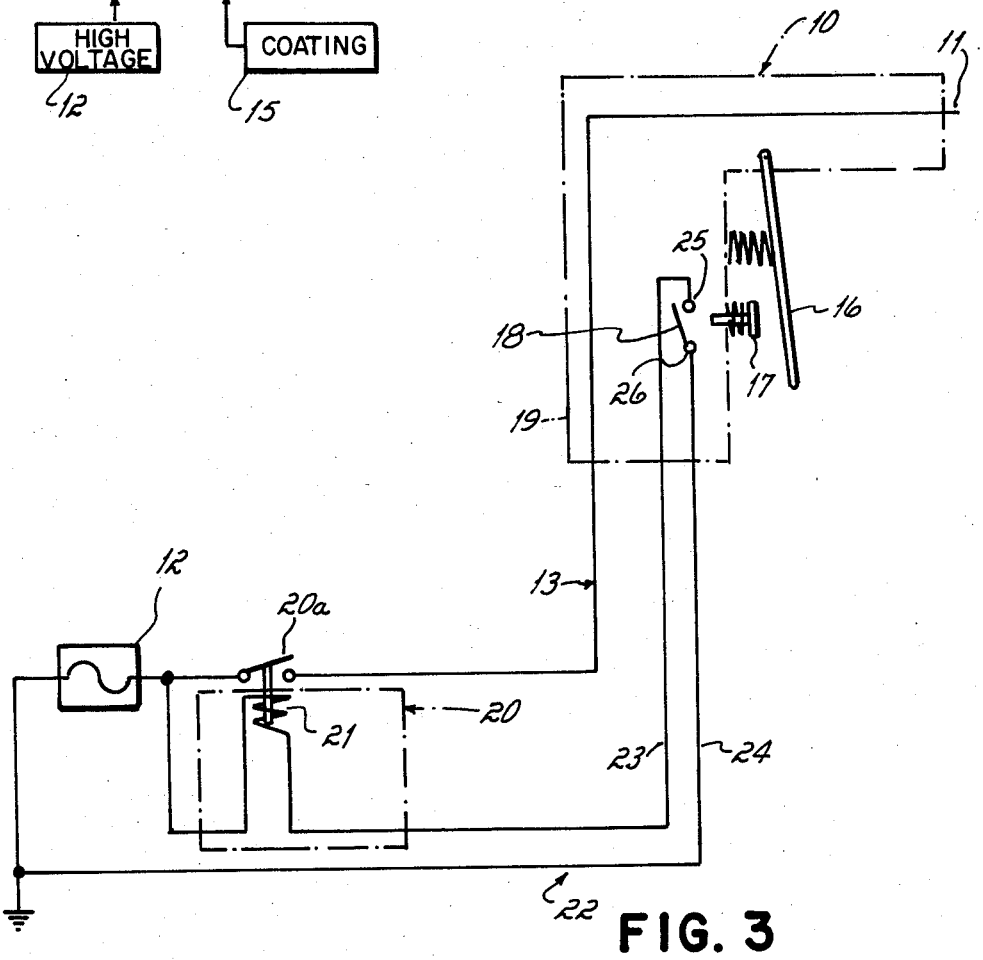
FIG. 3 is a diagrammatic view, illustrating one type of control circuitry.

In connection with the apparatus of FIG. 2, it will perhaps be helpful to a description of this embodiment if attention is first directed to the diagrammatic circuit of FIG. 3. This circuit is included for illustrating a simplified control circuitry which could be utilized in a spraying system with which the invention is utilized. In particular, an electrostatic cable 13 is connected to a source 12 of high voltage electrostatic energy through a normally opened relay switch **20*a* operated by a coil means 21 of control means 20. A reed switch 18 is connected between the coil and ground by means of a control cable 22 comprising wires 23 and 24. Wire 23 is connected to one side of the coil 21 and to one terminal 25 of the reed switch 18. Wire 24 is connected between another terminal 26 of the reed switch 18** and ground.

It will be appreciated that when the trigger 16 is urged in a direction so as to engage the magnet 17, the magnet moves toward the reed switch 18. Once the magnet comes into operative proximity to the reed switch 18, the reed switch closes, thereby connecting terminals 25 and 26 and energizing the coil 21. This serves to close the switch **20*a* of relay 20 and thus conduct high voltage electrostatic energy from the high voltage source 12 through the electrostatic cable 13 to the gun 10 and its electrode 11**.

Of course, this circuitry is very diagrammatic and any appropriate circuitry and relay means could be utilized. For example, the coil 21 could be replaced by any suitable form of integrated electronics, as is well known.

In any event, it will be appreciated that the gun 10 is connected through the electrostatic cable 13 to a source of high voltage electrostatic energy 12 and by the control cable 22 to a control means 20, such as the switch **20*a* and coil 21 forming a relay, or any other appropriate electrical means for selectively energizing the cable 13**.

In the past, it has been known to connect an electrostatic cable, such as the cable 13, to a handle of a spraying device such as a gun 10 by means of a coupling nut, rotatably connected to the cable in order to secure the cable in the gun and prevent inadvertent removal. At the same time, it has also been known to use a magnetically operated reed switch for controlling the energization of the electrostatic cable 13. Typically, such a reed switch was connected through wires to a receptacle located in the handle of the gun. This receptacle supported electrical receptacles for receiving the prongs of the two-wire control cable, these prongs simply being plugged into the receptacle at the gun handle. Any movement of the control cable with respect to the gun tended to cause the control cable plugs to work out or away from the electrical receptacle in the handle, thus causing the control cable at times to be unplugged. Also, such relative movement tended to pull the usually frictionally mounted receptacle away from the gun handle, putting great stress on the wires running between the receptacle and the reed switch. Also, it will be appreciated that the control cable could be indiscriminately unplugged from the receptacle simply by manually pulling the cable therefrom.

In accordance with the preferred embodiment of this invention, the control cable is rendered tool-removable only from the handle, while at the same time the receptacle and the plug are totally eliminated, as is undue stress on the wires connecting the control cable to the reed switch.

Turning now to FIG. 2, it will be appreciated that the control cable 22 comprises a two-wire cable (wires 23 and 24) forming at its end, according to the invention, a control cable terminal or switch plug which is integral with the control cable. Specifically, the control cable terminates in an integral insulating body 30 encapsulating the control wires 23, 24 and the reed switch 18 at a distal end of the control cable assembly, all as shown in FIG. 2. The control cable terminal or switch plug is best illustrated by the numeral 31, where it can be seen that the control cable terminal is elongated and extends from a position just outside the handle 19 to an operative position in the gun. The gun handle 19 includes a bore 32 for receiving the terminal or switch plug 31 in an operative position with respect to the reed switch 18 and the magnet 17, as shown.

Further describing the terminal 31, comprised in part by the insulating body 30, it will be appreciated that the reed switch 18 is mounted at the distal or upper end of the terminal 31 as shown in FIG. 2. Rearwardly thereof, the insulating body is provided with any number of appropriate circumferential grooves, such as that shown at 33, for receiving O-rings 34 for sealing the bore in the gun handle against the infiltration of foreign matter. Moreover, the insulating body 30 includes a circumferential projection or stop 35 between the reed switch 18 and the other end of the insulating body 30 attached to the cable 22. Stop 35 is provided in insulating body 30 to cooperate with a shoulder 36 in the bore 32 in order to accurately position the switch plug 31 in the handle 19.

Insulating body 30 includes a further recess, such as an annular groove 37, on the other side of the stop 35 from the reed switch 18. The recess 37 is located outwardly of the gun handle 19.

Accordingly, it will be appreciated that the insulated control cable 22 has a terminal 31 forming an integral end to the control cable and fully encapsulating the reed switch 18 and the conductive wires 23 and 24. There are no receptacles or plug associated with the end of the control cable, such as those prior devices as noted above. Moreover, it will be appreciated that the upper end of the terminal or switch plug 31 is located in operative proximity with respect to the magnet member 17 such that when the magnet member 17 is urged to the left, as viewed in FIG. 2, by the trigger 16, the reed switch is operated to close itself, thereby completing a circuit through wires 23 and 24 and back to control 27 for energizing the electrostatic cable 13, all as described above.

Returning now to FIG. 2, it will be appreciated that the electrostatic cable 13 is provided with a fitting 40 containing a recess such as an annular groove 41 therein. Fitting 40 is secured to the electrostatic cable against longitudinal movement with respect thereto.

Gun handle 19 is provided with a projection 42 which is externally threaded for receiving a coupling means, such as a coupling nut 43. Coupling nut 43 is provided with an internal recess, such as internal groove 44.

A yieldable latch means, such as a compressible/expandible snap ring 45, is disposed within the grooves 41 and 44. When the coupling nut is assembled to the electrostatic cable 13, the snap ring 45 is initially disposed within the groove 41 of the fitting 40. The coupling nut 43 is urged over the snap ring 45, thereby compressing it. When the groove 44 in the coupling nut 43 is aligned with the groove 41 in the fitting 40, the snap ring 45 expands outwardly so that a portion of the ring also is disposed within the groove 44. This connection maintains the coupling nut 43 against longitudinal movement with respect to the electrostatic cable, while at the same time permitting the nut to be rotated in a circumferential direction around the cable for threading onto the projection 42 and thereby for holding the electrostatic cable in the gun handle 19. Appropriate flats, indentations or recesses are provided on the coupling nut 43 so as to render the nut 43 only removable by a cooperating tool from the handle 19. It will thus be appreciated that the electrostatic cable 13 is held within the gun handle 19 and cannot be inadvertently removed or disconnected therefrom, there being required a particular tool to accomplish such an operation.

Figure 4:
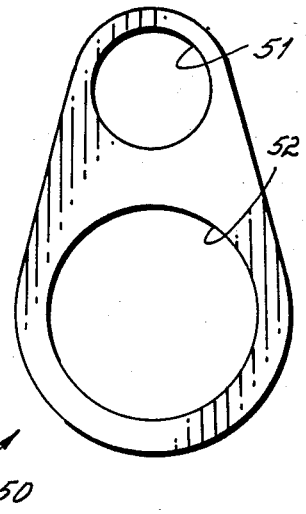
FIG. 4 is a plan view of the bracket, of FIGS. 1 and 2, for securing the control cable.

In order to secure the control cable 22 and its terminal 31 within the gun handle 19, the invention contemplates the utilization of the tool removable means described above with respect to the electrostatic cable 13 for the dual function of also removably securing the terminal 31 within the handle 19 in a manner so as to render it also removable only by tool. In this regard, attention is momentarily directed to FIG. 4, wherein is disclosed a bracket 50 having bores 51 and 52 therein. Bore 51 is configured to fit within the groove 37 of the insulating body 30, as shown in FIG. 2.

The coupling nut 43 is provided with a shoulder 53 and a further recess 54 located in an outer surface of the nut 43 and spaced from the shoulder 53. Recess 54 preferably comprises an annular groove.

A snap ring 55 is disposed within the groove 54 and secures the bracket 50, via bore 52, against the shoulder 53. In this regard, the tolerances of the parts are such that the bracket is maintained in the same relative longitudinal position on the nut 43, while at the same time the nut 43 is free to turn circumferentially within the bore 52 of the bracket 50. Accordingly, it will be appreciated that as the nut 43 is screwed onto the projection 42, the bracket 50 is also translated in a direction toward the gun handle, carrying with it the insulating body 30 and the terminal 31 at the end of the control cable 22. Once the coupling nut is tightened, it positively holds the electrostatic cable 13 within the handle 19 and, at the same time, by means of the bracket 50, positively holds the terminal 31 within the handle 19. This renders the terminal 31 immovable from the handle unless the appropriate tool is utilized to loosen and remove the nut 43 from the projection 42.

It will also be appreciated that the electrostatic control cable 13 and the control cable 22 may be attached together and even maintained within the same outer insulation, generally between the gun 10 and the electrostatic supply 12 and control 20. The electrostatic cable 13 and control cable 22 preferably separate at their terminal ends, as shown, for connection to the gun.

Accordingly, it will be appreciated that the invention provides an integral terminal for a control cable 22, thereby eliminating the necessity for plugs and receptacles at the gun handle for the control cable. The terminal 31 of the control cable 22 forms an integral terminal end for the cable which totally encapsulates an operating reed switch and is further constructed to operatively dispose the reed switch in proximity to a trigger-operated magnet. This mounting and encapsulation of the reed switch and the control wires 23 and 24 of the cable 22 relieves any stress which may otherwise be exerted on the wires, such as in the prior devices.

In addition, the invention provides means by which the terminal 31 and control cable 22 is only tool-removable from the gun handle. This is accomplished, as disclosed, by the utilization of the tool-removable coupling nut 43 for the electrostatic cable and an interconnecting bracket means for insuring that the terminal 31 can only be removed outwardly from the gun as the coupling nut 43 is removed therefrom to release the electrostatic cable from the gun as well.

Of course, it will be appreciated that various types of circuitry and various types of devices can be adapted for the utilization of the invention as herein described and that the invention can be modified to accommodate varying types of apparatus. These and other modifications and advantages will become readily apparent to those of ordinary skill in the art and without departing from the scope of the invention herein. Accordingly, applicant intends to be bound only by the claims appended hereto.

I claim:

1. Tool removable electrostatic cable and control cable system for an electrostatic spray gun and comprising:

an electrostatic cable;

a tool operated coupling nut means for holding said electrostatic cable in said gun;

a control cable terminating in an insulating body and connected to a switch encapsulated therein, said body being insertable into said gun for operation of said switch thereby to control conduction of electricity through said electrostatic cable;

a bracket means engaging said insulating body on said control cable;

said bracket means also being connected to said coupling nut means for maintaining said control cable, together with said electrostatic cable, in operative connection to said gun until said coupling nut is removed by tool from said gun.

2. Apparatus as in claim 1 and further comprising:

a fitting means secured to said electrostatic cable;

a groove in an outer surface of said fitting;

a groove in an inner surface of said coupling nut means;

a connecting ring means disposed in said grooves for preventing axial movement of said coupling nut means along said electrostatic cable, and permitting rotation of said coupling nut means with respect to said electrostatic cable;

said ring means being compressible into the groove of said fitting upon assembly of said coupling nut means thereto, and expansible into said groove in said coupling nut means for connecting said nut means to said fitting.

3. Apparatus as in claim 2, wherein said coupling nut means is rotatable with respect to said bracket, said bracket being rotationally secured to said coupling nut means.

4. Apparatus as in claim 1, wherein said insulating body includes:

a bracket receiving recess between respective ends of said body;

a stop means disposed around said body and between said switch and said bracket receiving recess for positioning said body in operative position in said gun with said bracket receiving recess aligned with said bracket means on said coupling nut means.

5. In an electrostatic and control cable system for an electrostatic spray gun, the combination of:

an electrostatic cable having a terminal end;

a control cable having a terminal end comprising an insulating body and a switch encapsulated therein, said switch operably coupled to said control cable;

said terminal ends being spaced apart from each other;

tool removable coupling nut means surrounding one of either said electrostatic cable or said control cable for releasably coupling same to said spray gun; the other cable being spaced externally from said coupling nut; and bracket means rotatably secured to said coupling nut means and also secured to the terminal end of said other cable for holding said other cable terminal end in operative connection with said spray gun while said one cable is connected to said gun by said coupling nut means.

6. The combination of claim 5, wherein said coupling nut means surrounds said electrostatic cable and further comprising:

a fitting connected to said electrostatic cable and having first recess means therein;

second recess means disposed in said coupling nut means;

yieldable catch means disposed in said first and second recess means for permitting rotation of said coupling nut means with respect to said fitting and for securing said coupling nut means against longitudinal movement with respect to said fitting and said electrostatic cable.

7. The combination of claim 6, wherein an outer surface of said coupling nut means comprises a shoulder, and further including a circumferential recess spaced from said shoulder and a bracket retainer disposed in said recess, said bracket secured to said coupling nut means between said shoulder and said bracket retainer.

* * * * *